US006356235B2

(12) United States Patent
Laidig et al.

(10) Patent No.: US 6,356,235 B2
(45) **Date of Patent: *Mar. 12, 2002**

(54) GROUND BASED ANTENNA ASSEMBLY

(75) Inventors: David R. Laidig, Phoenix; John W. Locke, Mesa, both of AZ (US)

(73) Assignee: Motorola, Inc., Schaumburg, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/399,264

(22) Filed: Sep. 20, 1999

(51) Int. Cl.[7] ..... H01Q 3/02

(52) U.S. Cl. ..... 343/700 MS; 343/846; 343/848; 343/849; 343/893

(58) Field of Search ..... 343/700 MS, 846, 343/848, 847, 757, 758, 778, 893, 705

(56) References Cited

U.S. PATENT DOCUMENTS

| | | | | | |
|---|---|---|---|---|---|
| 2,935,747 | A | | 5/1960 | Ghose | 343/767 |
| 3,100,892 | A | | 8/1963 | Cutler | 343/100 |
| 3,152,330 | A | | 10/1964 | Chatelain | 343/705 |
| 3,594,808 | A | | 7/1971 | Koob et al. | 343/799 |
| 3,715,759 | A | | 2/1973 | Esposito et al. | 343/792.5 |
| 3,811,127 | A | | 5/1974 | Griffee et al. | 343/705 |
| 3,829,863 | A | * | 8/1974 | Lipsky | 343/773 |
| 4,074,268 | A | * | 2/1978 | Olson | 343/118 |
| 4,297,711 | A | | 10/1981 | Ekstrom | 343/794 |
| 4,329,690 | A | | 5/1982 | Parker | 343/709 |
| 4,792,808 | A | | 12/1988 | Hildebrand | 343/853 |
| 4,878,062 | A | | 10/1989 | Craven et al. | 343/872 |
| 4,963,878 | A | * | 10/1990 | Kildal | 343/781 P |
| 5,153,601 | A | * | 10/1992 | Milne | 343/754 |
| 5,173,715 | A | | 12/1992 | Rodal et al. | 343/795 |
| D338,206 | S | | 8/1993 | Sawaguchi et al. | D14/230 |
| 5,333,002 | A | | 7/1994 | Gans et al. | 343/700 |
| 5,351,060 | A | * | 9/1994 | Bayne | 343/766 |
| 5,389,941 | A | | 2/1995 | Yu | 343/797 |
| 5,521,610 | A | | 5/1996 | Rodal | 343/797 |
| 5,552,798 | A | | 9/1996 | Dietrich et al. | 343/893 |
| 5,604,508 | A | | 2/1997 | Atkinson | 343/879 |
| 5,642,122 | A | | 6/1997 | Lockie et al. | 343/881 |
| 5,764,192 | A | * | 6/1998 | Fowler et al. | 343/705 |
| 5,905,466 | A | * | 5/1999 | Jha | 343/700 MS |
| 6,049,305 | A | * | 4/2000 | Tassoudji et al. | 342/357.16 |

FOREIGN PATENT DOCUMENTS

| | | | |
|---|---|---|---|
| EP | 0546812 | 6/1993 | H01Q/1/28 |
| EP | 0698972 | 2/1996 | H04B/7/185 |
| EP | 0767511 | 4/1997 | H01Q/21/06 |
| JP | 0151325 | 6/1989 | H04B/7/10 |
| JP | 9103846 | 3/1991 | H01Q/3/24 |
| WO | 9923769 | 5/1999 | H04B/7/185 |

* cited by examiner

*Primary Examiner*—Don Wong
*Assistant Examiner*—Tuyet Thi Vo
(74) *Attorney, Agent, or Firm*—Timothy J. Lorenz; Sharon Coleman; Frank J. Bogacz

(57) ABSTRACT

A ground-based antenna assembly (10) is provided that includes an assembly base (14) defining a substantially horizontal plane (18) and configured for attachment to a residential, commercial or governmental structure. The ground-based antenna (10) also includes a plurality of planar receiving panels (22) having a circular and/or elliptical shape. The plurality of planar receiving panels (22) are radially-spaced about the assembly base (14) and tilted with respect to the substantially horizontal plane (18) for a receiving field-of-view. The ground-based antenna assembly (10) further includes a plurality of planar transmitting panels (26) having a circular and/or elliptical shape. The plurality of planar transmitting panels (26) are radially-spaced about the assembly base (14) and tilted with respect to the substantially horizontal plane (18) for a transmitting field-of-view. In addition, the plurality of transmitting panels (26) are radially offset and nested with respect to the plurality of receiving panels (22).

25 Claims, 3 Drawing Sheets

GROUND BASED ANTENNA ASSEMBLY

BACKGROUND OF THE INVENTION

1. Field of the Invention

The present invention is directed to an antenna assembly, and is more particularly directed to a ground-based antenna assembly.

2. Background Information

In recent years, the telecommunications industry has seen the development and deployment of commercial non-geostationary orbit (NGSO) communication systems. These NGSO communication systems form a network of nodes that deliver a variety of interactive services to residential, commercial and government subscribers at a cost that is substantially less than previously available. However, in order to provide satisfactory performance under most, but not necessarily all operating conditions, a ground-based antenna is needed that will provide transmission and/or reception capabilities at residential, commercial or governmental locations under the unique operating conditions presented by a NGSO communication system and many other communication system configurations.

For example, due to the relatively rapid speeds in which the satellites in an NGSO communication system move over the surface of an underlying celestial body, such as the Earth, each NGSO satellite is visible to particular user locations for relatively small increments of time. Therefore, the ground-based antenna associated with a particular subscriber location must be able to support a hand-off process that involves switching communication services between cells or beams of a single satellite footprint and/or between cells or beams of different satellites within the NGSO communication system. This support of the hand-off process by the ground-based antenna is generally enhanced if maximum hemispherical coverage is available (i.e., a 360-degree azimuth field-of-view from horizon to zenith).

One prior art ground-based antenna that provides substantial hemispherical coverage is a mechanically positioned dish antenna. However, as may be appreciated, the minimization of moving components in an antenna is preferred as this minimization increases reliability and decreases mechanically generated noise and vibration. A mechanically non-moving alternative to the mechanically positioned dish antenna is the electronically scanned phased array antenna. While reliability is increased and mechanically generated noise is decreased due to a substantial reduction of mechanical moving parts in a phased array antenna, different concerns arise when a phased array antenna is placed at a subscriber location.

Generally, phased array antenna apertures have a scanning range that is limited to 55–60 degrees off the mechanical boresight (i.e., the normal to the aperture plane). Therefore, if the 360-degree field-of-view from horizon to zenith is sought, multiple phased array antenna apertures must be used to form an antenna assembly that will provide this area coverage. In addition, as the frequency band allocated for the communication system uplink is generally different than the frequency band for the communication system downlink, and also significantly separated in frequency, separate antenna apertures are typically needed in a phased array antenna assembly. Furthermore, as a relatively high antenna gain is preferred to enhance the uplink and downlink in the communication system, the diameters of the phased array antenna apertures are relatively large. Therefore, in order to provide the aforementioned field-of-view, a number of large diameter transmit apertures and a number of large diameter receive apertures may be required and the complete antenna assembly may have a large size. As a large antenna assembly size in a residential, commercial or governmental user setting is aesthetically and economically undesirable, size reduction in a phased array antenna assembly is advantageous.

Accordingly, a ground based antenna assembly for use in communication with a plurality of satellites is desired that has a reduced number of mechanically moving parts and a overall size that is minimized. Furthermore, additional advantages and features of the present invention will become apparent from the subsequent description and the appended claims, taken in conjunction with the accompanying drawings.

BRIEF SUMMARY OF THE INVENTION

In accordance with the teachings of the present invention, a ground-based antenna assembly is disclosed herein. The ground-based antenna assembly includes an assembly base defining a plane and plurality of receiving panels having a first conic shape. The plurality of receiving panels are radially-spaced a first radial distance about the assembly base and tilted at a first angle with respect to the plane for a receiving field-of-view. The ground-based antenna also includes a plurality of transmitting panels having a second conic shape. The plurality of transmitting panels are radially-spaced a second radial distance about the assembly base and tilted at a second angle with respect to the plane for a transmitting field-of-view. In addition, the plurality of transmitting panels are radially offset and nested with respect to the plurality of receiving panels.

BRIEF DESCRIPTION OF THE DRAWINGS

The present invention will hereinafter be described in conjunction with the appended drawing figures, wherein like numerals denote like elements, and.

DETAILED DESCRIPTION OF THE INVENTION

Figure 1:
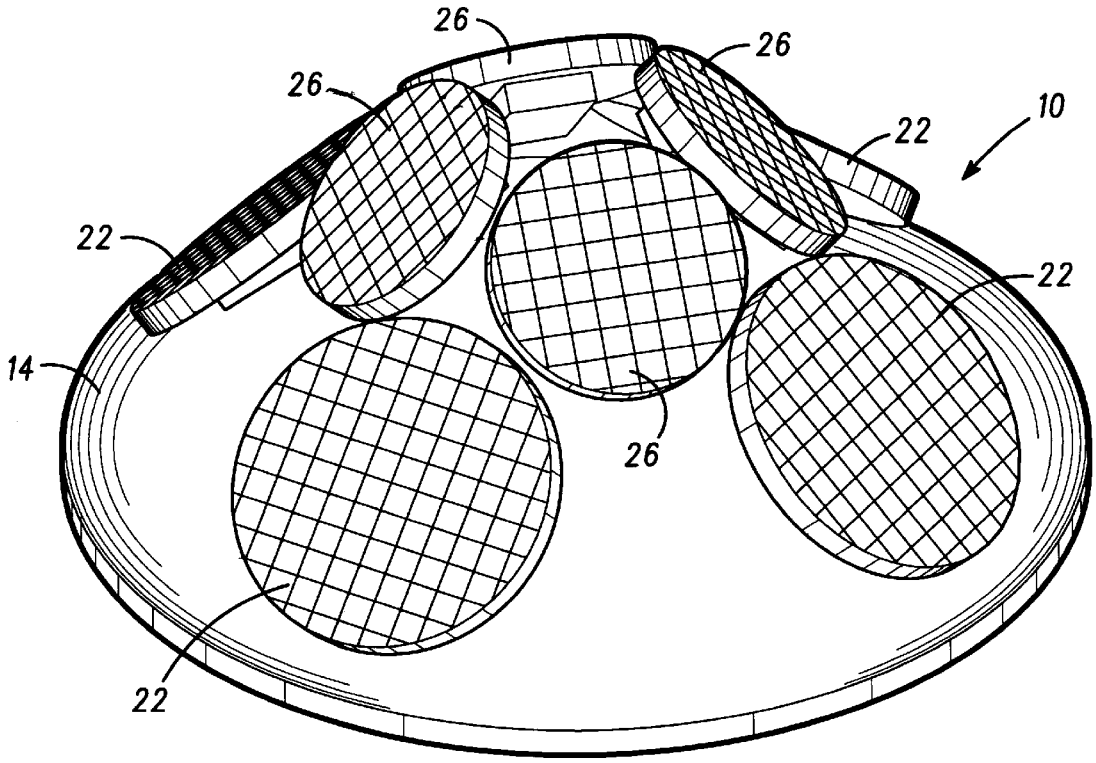
FIG. 1 is an isometric view of a ground-based antenna assembly according to a first exemplary embodiment of the invention.
Figure 2:
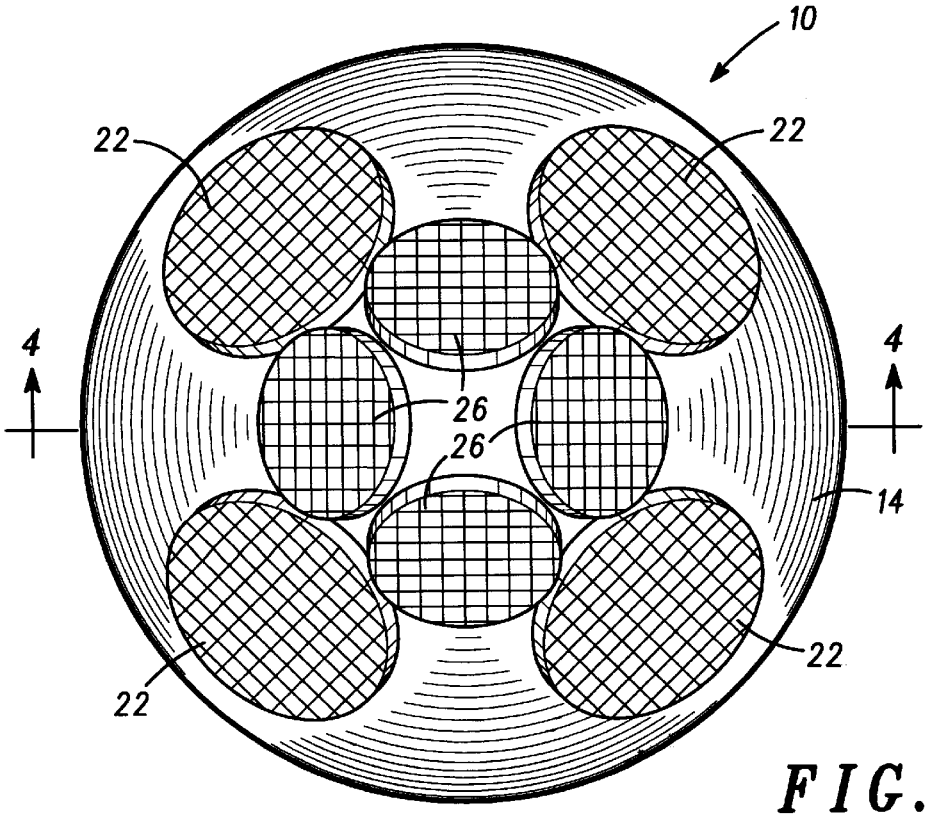
FIG. 2 is a top view of the ground-based antenna assembly of FIG. 1.
Figure 3:
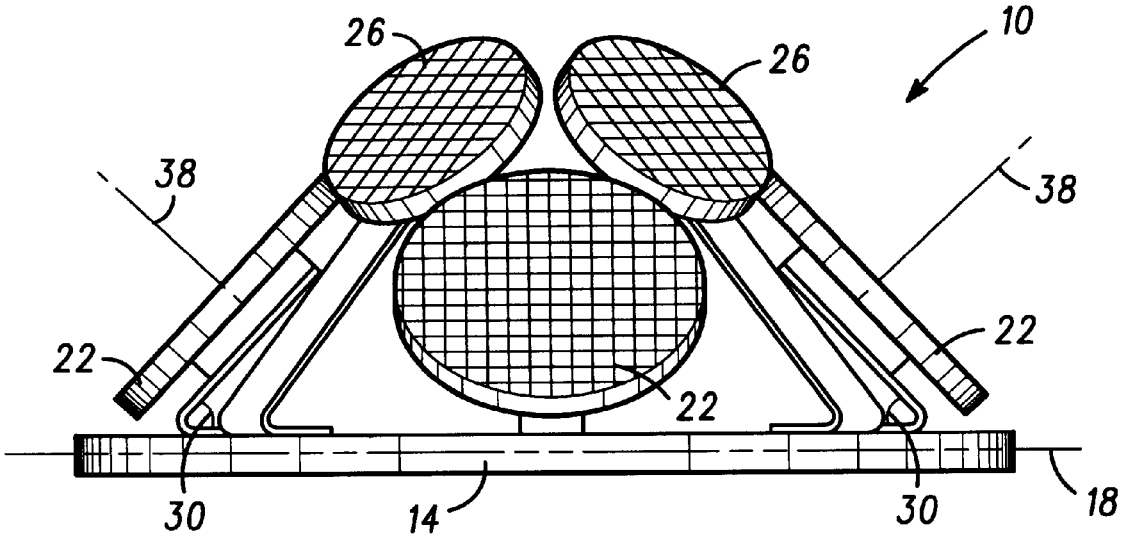
FIG. 3 is a side-view of the ground-based antenna assembly of FIGS. 1 and 2.
Figure 4:
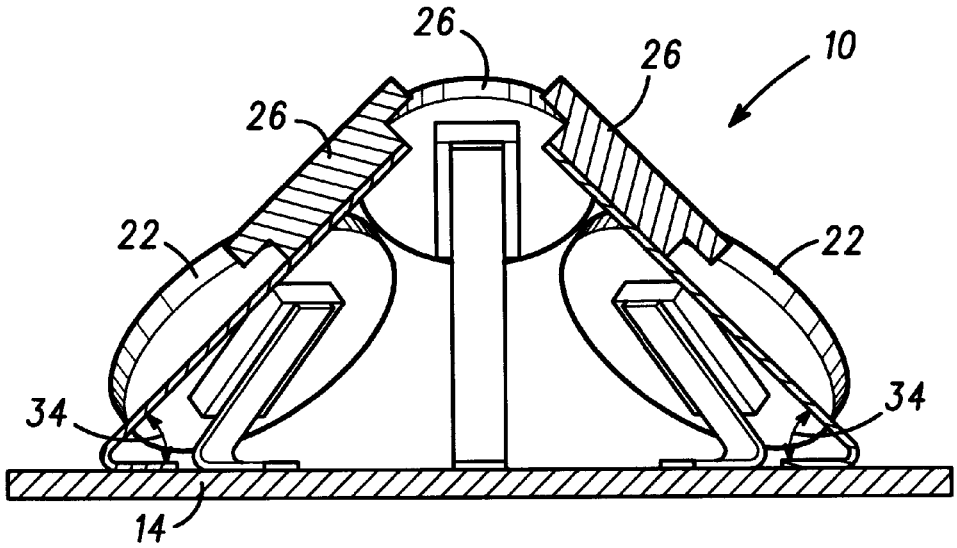
FIG. 4 is a cross-sectional view of the ground-based antenna assembly, taken through section line 4—4 of FIG. 2.

The ensuing detailed description of the invention provides preferred exemplary embodiments only, and is not intended to limit the scope, applicability, or configuration of the invention in any way. Rather, the ensuing detailed description of the invention will provide those skilled in the art with a convenient road map for implementing a preferred exemplary embodiment of the invention, it being understood that various changes may be made in the function and arrangement of elements described in an exemplary preferred embodiment without departing from the spirit and scope of the invention as set forth in the appended claims.

FIGS. 1–4 illustrate a ground-based antenna assembly 10 according to an exemplary embodiment of the present invention. The ground-based antenna assembly 10 includes an assembly base 14 defining a plane 18, multiple receiving panels 22 having a first conic shape, and multiple transmitting panels 26 having a second conic shape. The multiple receiving panels 22 are radially-spaced about the assembly base 14 and tilted at a first angle 30 with respect to the plane 18 for a receiving field-of-view. The multiple transmitting panels 26 are radially-spaced about the assembly base 14, tilted at a second angle 34 with respect to the plane 18 for a transmitting field-of-view, and radially-offset and nested with respect to the multiple receiving panels 22.

The assembly base 14 may be any number of geometric shapes, such as a circle, ellipse, square, rectangle or triangle, for example. The assembly base 14 is preferably configured for temporary or substantially permanent attachment to a residential, commercial or governmental structure, or alternatively to a mobile unit, which is to communicate with an aerial or space-based communication system. The communication system may be any number of existing or future communication systems, including, but not limited to communication systems employing a single non-geostationary orbit (NGSO) or single geostationary satellite, or multiple NGSO or multiple geostationary satellites or any combination of NGSO and geostationary satellites.

The receiving panels 22 and transmitting panels 26 are substantially fixed to a mounting structure (not shown) that is attached to the assembly base 14. This substantial fixation of the multiple receiving panels 22 and multiple transmitting panels 26 to the mounting structure and the mounting structure attachment to the assembly base 14 provides minimal mechanical movement of the ground-based antenna assembly 10. The mounting structure may be any number of hardware supports, including, but not limited to, a single support bracket (not shown) for substantially all of the multiple receiving panels 22 and/or multiple transmitting panels 26 or individual support brackets (not shown). The mounting structure is configured to hold the multiple receiving panels 22 at the first angle 30 and the multiple transmitting panels 26 at the second angle 34. The first angle 30 and the second angle 34 may be the same angle or may be varied in order to provide the same or different field-of-view for signal reception and transmission by the ground-based antenna assembly 10.

Figure 5:
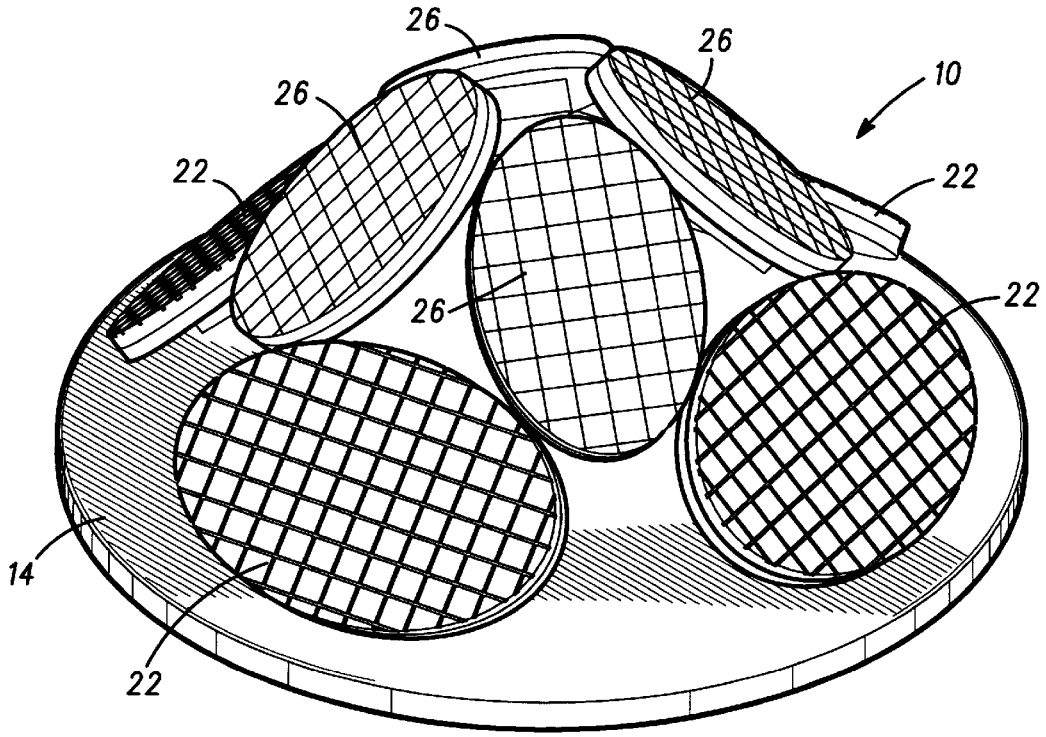
FIG. 5 is an isometric view of a ground-based antenna assembly having elliptically shaped panels according to an exemplary embodiment of the invention.

The multiple receiving panels 22 and multiple transmitting panels 26 may be any number of electronically steerable antenna sub-units, such as phased array antennas, having conic forms that include, but is not limited to circular shapes as shown in FIGS. 1–4 or elliptical shapes as shown in FIG. 5. The multiple receiving panels 22 and multiple transmitting panels 26 may have very similar conic shapes or alternatively the conic shape of the multiple receiving panels 22 may be different than the conic shape of the multiple transmitting panels 26. Furthermore, as the area size of the multiple receiving panels 22 and multiple transmitting antennas 26 is selected based upon the frequency band and antenna gain, the size of the multiple receiving panels 22 is likely different than the size of the multiple transmitting panels 26 to support different reception and transmission frequency bands. For example, in a preferred exemplary embodiment, the size of the multiple receiving panels 22 is selected for reception of a frequency range of approximately 20 GHz±5 GHz and the size of the multiple transmitting panels 26 is selected for a frequency range of approximately 30 GHz±5 GHz. However, the size of the multiple receiving panels 22 and multiple transmitting panels 26 may be the same or substantially the same size.

The electronically steerable antenna sub-units forming each of the multiple receiving panels 22 and multiple transmitting panels 26 generally have a limited scanning range. For example, phased array antennas currently have a scanning range that is limited to approximately fifty-five to sixty (55–60) degrees off the mechanical boresight 38 (i.e., the normal to a panel). Therefore, in order to provide a hemispherical coverage without mechanically moving the multiple receiving panels 22 and transmitting panels 26, multiple receiving panels 22 and multiple transmitting panels 26 are tilted with respect to the plane 18 as previously discussed and radially spaced about the assembly base 14. Furthermore, while four receiving panels and four transmitting panels are shown in this detailed description of an exemplary embodiment, it should be understood that three (3) or more may be utilized depending upon the desired hemispherical coverage. For example, if a three hundred and sixty (360) degree field-of-view from sixteen (16) degrees above the horizon to the zenith is sought, and the scanning range of the phased array antenna is sixty (60) degrees, three (3) receiving and transmitting panels may be radially-spaced at one hundred and twenty (120) degree intervals and tilted at an angle of forty five (45) degrees to provide the this coverage. However, if a three hundred and sixty (360) degree field-of-view from sixteen (16) degrees above the horizon to the zenith is sought and the scanning range of the phased array antenna is fifty five (55) degrees, four (4) receiving and transmitting panels may be radially-spaced at ninety (90) degree intervals.

As may be appreciated from the proceeding, multiple receiving panels and multiple transmitting panels are generally necessary to provide substantial hemispherical coverage when the antenna assembly components are substantially non-moving. As a smaller antenna assembly size is desirable in residential, commercial or governmental settings for both aesthetic and economic reasons, the multiple transmitting panels 26 are radially offset and nested with respect to the multiple receiving panels 22 in order to reduce the size of the ground-based antenna assembly. However, it should be understood that radially offsetting and nesting the multiple receiving panels 22 with respect to the multiple transmitting panels 26 similarly reduces the size of the ground-based antenna assembly.

Figure 6:
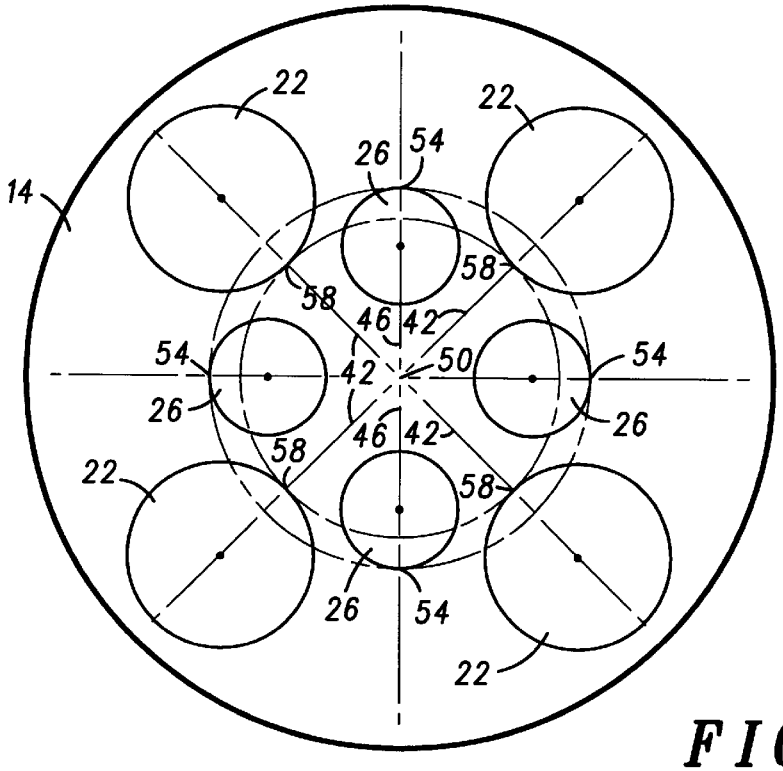
FIG. 6 is a planar top view of the ground-based antenna assembly of FIG. 1.

For example and with specific reference to FIG. 6, the multiple receiving panels 22 are radially spaced a first radial distance 42 from an arbitrary reference point 50 on the assembly base 14 and the multiple transmitting panels 26 are radially spaced a second radial distance 46 from the arbitrary reference point 50 that is greater than the first radial distance 42. In addition, each of the multiple transmitting panels 26 are placed between two of the multiple receiving panels 22 such that the lower portion 54 of each of the multiple transmitting panels 26 is below the upper portion 58 of the two of the multiple receiving panels 22 on each side of each of the multiple transmitting panel 26 (i.e., radially off-set and nested). Alternatively, the radially off-setting and nesting may be accomplished by selecting a second radial distance 46 that is less than the first radial distance 42 and placing each of the multiple receiving panels 22 between two of the multiple transmitting panels 26 such that the upper portion of the transmitting panel is above the lower portion of the multiple receiving panels 22 on each side of one of the multiple transmitting panels 26. Furthermore, it should be understood that the radial distance of each individual transmitting and/or receiving panel do not necessarily need to be the same in order to realize the size reduction attributable to the radially offsetting and nesting scheme presented herein.

From the foregoing description, it may be appreciated that the present invention provides a ground-based antenna assembly that has a reduced number of mechanically moving parts with an assembly size that is minimized for a given set of panels. Furthermore, those skilled in the art can now appreciate from the foregoing description that the broad teachings of the present invention can be implemented in a variety of forms. The principles provided here are readily adaptable for many applications. Therefore, the true scope of the invention is vast, and other modifications will become apparent to the skilled practitioner upon a study of the specification, including drawings, and the following claims.

What is claimed is:

1. A ground-based antenna assembly, comprising:

an assembly base defining a plane;

a plurality of receiving panels having a first conic shape, said plurality of receiving panels radially-spaced a first radial distance from a reference point on said assembly base and tilted at a first angle with respect to said plane of said assembly base for a receiving field-of-view;

a plurality of transmitting panels having a second conic shape, said plurality of transmitting panels radially-spaced a second radial distance from said reference point on said assembly base that is greater than said first distance and tilted at a second angle with respect to said plane of said assembly base for a transmitting field-of-view, wherein a first transmitting panel of said plurality of transmitting panels is located between a first receiving panel and a second receiving panel of said plurality of receiving panels such that a lower portion of said first transmitting panel is below an upper portion of said first receiving panel and said second receiving panel.

2. The ground-based antenna assembly of claim 1, wherein said first conic shape is a circle.

3. The ground-based antenna assembly of claim 1, wherein said second conic shape is a circle.

4. The ground-based antenna assembly of claim 1, wherein said first conic shape is an ellipse.

5. The ground-based antenna assembly of claim 1, wherein said second conic shape is an ellipse.

6. The ground-based antenna assembly of claim 1, wherein said plurality of transmitting panels are configured to transmit a frequency in the range of 30 GHz.

7. The ground based antenna of claim 1, wherein each of said plurality of transmitting panels is located between two receiving panels of said plurality of receiving panels such that a lower portion of said each of said plurality of transmitting panels is below an upper portion of said two receiving panels.

8. The ground based antenna of claim 1, wherein said first conic shape is a circle.

9. The ground based antenna of claim 1, wherein said second conic shape is a circle.

10. The ground based antenna of claim 1, wherein said first conic shape and said second conic shape is a circle.

11. The ground based antenna of claim 1, wherein said first conic shape is an ellipse.

12. The ground based antenna of claim 1, wherein said second conic shape is an ellipse.

13. The ground based antenna of claim 1, wherein said plurality of receiving panels are configured to receive a frequency of about twenty (20) GHz.

14. The ground based antenna of claim 1, wherein said plurality of transmitting panels are configured to transmit a frequency of about thirty (30) GHz.

15. The ground based antenna of claim 1, wherein the area of said first conic shape is greater than the area of said second conic shape.

16. A ground-based antenna assembly, comprising:

an assembly base defining a plane;

a plurality of transmitting panels having a first conic shape said plurality of transmitting panels radially-spaced a first radial distance from a reference point on said assembly base and tilted at a first angle with respect to said plane of said assembly base for a transmitting field-of-view;

a plurality of receiving panels having a second conic shape, said plurality of receiving panels radially-spaced a second radial distance from said reference point on said assembly base that is greater than said first distance and tilted at a second angle with respect to said plane of said assembly base for a receiving field-of-view, wherein a first receiving panel of said plurality of receiving panels is located between a first transmitting panel and a second transmitting panel of said plurality of transmitting panels such that a lower portion of said first receiving panel is below an upper portion of said first transmitting panel and said second transmitting panel.

17. The ground based antenna of claim 16, wherein each of said plurality of receiving panels is located between two transmitting panels of said plurality of transmitting panels such that a lower portion of said each of said plurality of receiving panels is below an upper portion of said two transmitting panels.

18. The ground based antenna of claim 16, wherein said first conic shape is a circle.

19. The ground based antenna of claim 16, wherein said second conic shape is a circle.

20. The ground based antenna of claim 16, wherein said first conic shape and said second conic shape is a circle.

21. The ground based antenna of claim 16, wherein said first conic shape is an ellipse.

22. The ground based antenna of claim 16, wherein said second conic shape is an ellipse.

23. The ground based antenna of claim 16, wherein said plurality of receiving panels are configured to receive a frequency of about twenty (20) GHz.

24. The ground based antenna of claim 16, wherein said plurality of transmitting panels are configured to transmit a frequency of about thirty (30) GHz.

25. The ground based antenna of claim 16, wherein the area of said first conic shape is greater than the area of said second conic shape.

* * * * *